US011364611B2

(12) United States Patent
Schallert et al.

(10) Patent No.: US 11,364,611 B2
(45) Date of Patent: Jun. 21, 2022

(54) HAND-HELD POWER TOOL

(71) Applicant: Hilti Aktiengesellschaft, Schaan (LI)

(72) Inventors: Christian Schallert, Nueziders (AT); Jürgen Pritz, Rankweil (AT); Marcel Wondra, Bludenz (AT); Carl Hoffmann, Lindau (DE); Walter Vallaster, Göfis (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 17/291,216

(22) PCT Filed: Dec. 20, 2019

(86) PCT No.: PCT/EP2019/025465

§ 371 (c)(1),
(2) Date: May 4, 2021

(87) PCT Pub. No.: WO2020/126089

PCT Pub. Date: Jun. 25, 2020

(65) Prior Publication Data

US 2021/0402583 A1 Dec. 30, 2021

(30) Foreign Application Priority Data

Dec. 20, 2018 (EP) ..... 18214666

(51) Int. Cl.
*B25D 11/12* (2006.01)
*B25D 11/06* (2006.01)

(52) U.S. Cl.
CPC ..... *B25D 11/125* (2013.01); *B25D 11/062* (2013.01); *B25D 2250/095* (2013.01)

(58) Field of Classification Search
CPC ..... B25D 11/062; B25D 11/125; B25D 2211/003; B25D 2211/062; B25D 2250/095

(Continued)

(56) References Cited

U.S. PATENT DOCUMENTS 3,587,754 A 6/1971 Laatsch et al.
4,095,654 A * 6/1978 Ross ..... B25D 11/125 173/117

(Continued)

FOREIGN PATENT DOCUMENTS

EP 1 431 005 A2 6/2004
GB 819055 A 8/1959

(Continued)

OTHER PUBLICATIONS

International Bureau, International Search Report in International Application No. PCT/EP2019/025465, dated Feb. 13, 2020.

(Continued)

*Primary Examiner* — Thanh K Truong
*Assistant Examiner* — David G Shutty
(74) *Attorney, Agent, or Firm* — Leydig, Voit & Mayer, Ltd.

(57) ABSTRACT

A chiseling hand-held power tool having a tool holder for holding a tool on a working axis, an electric motor, and a striking mechanism. The striking mechanism has an excitation piston coupled to the motor, a striker guided on the working axis and a pneumatic chamber closed by the excitation piston and the striker for coupling a movement of the striker to the excitation piston. The rotational speed of the electric motor corresponds to at least 20 times the striking rate of the striking mechanism.

12 Claims, 1 Drawing Sheet

(58) Field of Classification Search
USPC ..... 173/117
See application file for complete search history.

(56) References Cited

U.S. PATENT DOCUMENTS

| | | | | |
|---|---|---|---|---|
| 7,048,076 | B2 * | 5/2006 | Cecchin | B25D 11/125 173/216 |
| 2004/0182589 | A1 | 9/2004 | Cecchin et al. | |
| 2010/0012337 | A1 * | 1/2010 | Meixner | B25D 11/125 173/114 |

FOREIGN PATENT DOCUMENTS

| | | | |
|---|---|---|---|
| GB | 1 210 006 | A | 10/1970 |
| WO | WO 2008/071489 | A1 | 6/2008 |

OTHER PUBLICATIONS

International Bureau, Written Opinion of the International Searching Authority in International Application No. PCT/EP2019/025465, dated Feb. 13, 2020.

* cited by examiner

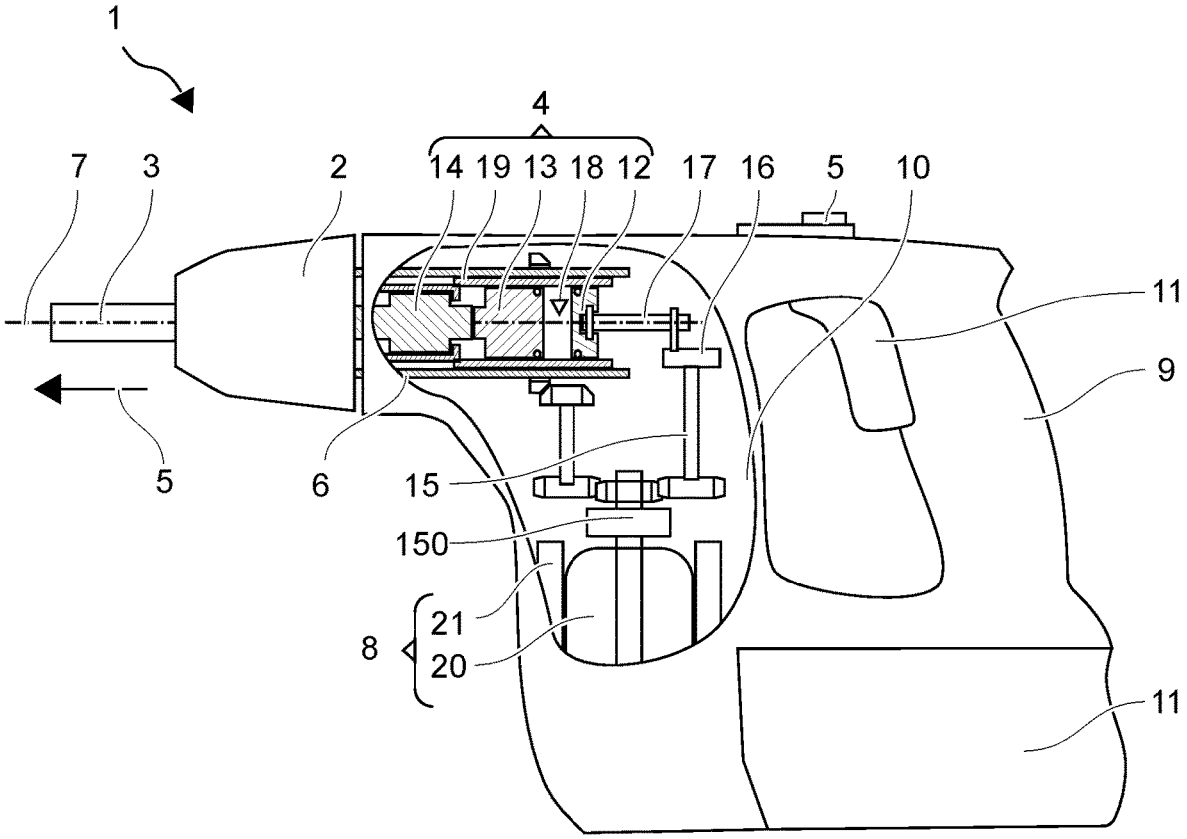
1
4
7
3
2
14
19
13
18
12
17
16
5
10
11
9
5
6
15
150
21
8
20
11

HAND-HELD POWER TOOL

CROSS-REFERENCE TO RELATED APPLICATIONS

This patent application is the U.S. National Stage of International Patent Application No. PCT/EP2019/025465, filed Dec. 20, 2019, which claims the benefit of European Patent Application No. 18214666.2, filed Dec. 20, 2018, which are each incorporated by reference.

FIELD OF THE INVENTION

The present invention relates to a portable power chiseling tool, for example a hammer drill or an electric chisel.

WO 2008/071489 A1 describes a portable power chiseling tool. The portable power tool has a pneumatic striking mechanism, which is driven by an electric motor. A reduction gear unit adapts the speed of the electric motor to the striking rate of the striking mechanism. The reduction gear unit has a first stage and a second stage. The second stage is designed as part of an eccentric gearwheel to enable this to be integrated into the portable power tool in view of spatial restrictions.

GB 1 210 006 describes a portable power chiseling tool, the transmission of which is exposed to high loads. The loading results from the reaction forces of the striking mechanism and also when a drill bit is blocked. In this case, the teeth of the transmission stages can break. The transmission is of correspondingly robust design.

DISCLOSURE OF THE INVENTION

A portable power chiseling tool has a tool holder for holding a tool on a working axis, an electric motor and a striking mechanism. The striking mechanism has an exciter piston coupled to the motor, a striker guided on the working axis, and a pneumatic chamber which is closed by the exciter piston and the striker and is provided for coupling a movement of the striker to the exciter piston. The speed of the electric motor corresponds to at least 20 times a striking rate of the striking mechanism. The speed of the electric motor is greater than 80,000 revolutions per minute. The ratio of the mass of the electric motor (8) to the rated power of the electric motor is less than 0.2 g/W.

The advantages of a lightweight high-speed electric motor are balanced out inter alia by the necessity of an additional stage for speed reduction and the increased sensitivity thereof. According to the invention, it has been recognized that, starting from the currently customary speeds of 25,000 rpm, no positive effect is to be expected if the speed is doubled to 50,000 rpm. The disadvantages of the additional transmission stage predominate. However, in this way it has been recognized that there is a positive effect from high speeds above 80,000 rpm.

BRIEF DESCRIPTION OF THE DRAWINGS

The following description explains the invention on the basis of exemplary embodiments and figures, in which:

FIG. 1 shows a hammer drill

Identical or functionally identical elements are indicated by the same reference numerals in the figures, unless stated otherwise.

EMBODIMENTS OF THE INVENTION

FIG. 1 schematically shows a hammer drill as an example of a portable power chiseling tool 1. The hammer drill has a tool holder 2 into which a tool 3 can be inserted and locked. The tools 3 can be, for example, drill bits for chiseling mineral construction materials, such as concrete or rock, by turning, or chisels for purely chiseling the same construction materials. The hammer drill 1 contains a pneumatic striking mechanism 4, which, during operation, periodically exerts blows in the striking direction 5 on the tool 3. In addition, the power tool 1 can have an output shaft 6, which, during operation, rotates the tool holder 2 and therefore the tool 3 about a working axis 7. The striking mechanism 4 and the output shaft 6 are driven by an electric motor 8. The output shaft 6 can be switched off in portable power chiseling tools 1; purely chiseling portable power tools 1 are without an output shaft.

The portable power tool 1 has a handle 9, by means of which the user can hold and guide the portable power tool 1 in operation. The handle 9 is fastened to a machine housing 10. The handle 9 is preferably arranged at an end of the portable power tool 1 or of the machine housing 10 that is remote from the tool holder 2. A working axis 7 running parallel to the striking direction 5 and centrally through the tool holder 2 preferably runs through the handle 9, when the latter has to be grasped by one hand. The handle 9 can be partially decoupled from the machine housing 10 by damping elements in order to damp vibrations of the striking mechanism 4.

The user can put the portable power tool 1 into operation by means of a switch 11. Actuation of the switch 11 activates the motor 8. The switch 11 is preferably arranged on the handle 9, as a result of which the latter can be actuated by the hand grasping the handle 9.

The striking mechanism 4 has an exciter piston 12, a striker 13 and an anvil 14. The exciter piston 12, the striker 13 and the anvil 14 are arranged lying on the working axis 7 following one another in the striking direction 5. The exciter piston 12 is coupled to the motor 8 via a gear train 15. The gear train converts the rotational movement of the motor 8 into a periodic forward and backward movement of the exciter piston 12 on the working axis 7. An exemplary gear train contains an eccentric gear 16 and a connecting rod 17. The gear train 15 can contain inter alia a reduction gear unit which adapts the speed of the electric motor 8 to the speed of the eccentric gear 16. The speed of the eccentric gear 16 corresponds to the nominal striking rate of the striking mechanism 4. Instead of an eccentric gear 16, other mechanisms can convert the rotary motion of the electric motor 8 into the translational motion of the exciter piston 12, e.g. a wobble drive.

The striker 13 is coupled to the movement of the exciter piston 12 by a pneumatic chamber 18, also referred to as an air spring. The pneumatic chamber 18 is closed along the working axis 7 by the exciter piston 12 on the drive side and by the striker 13 on the tool side. For this purpose, the striker 13 is in the form of a piston. In the variant illustrated, the pneumatic chamber 18 is closed in the radial direction by a guide tube 19. The exciter piston 12 and the striker 13 slide in an air-tight manner lying against the inner surface of the guide tube 19. In another refinement, the exciter piston can be designed in the form of a cup. The striker slides within the exciter piston. The striker can analogously be designed in the form of a cup, with the exciter piston sliding within the striker. The striker 13, coupled via the pneumatic chamber 18, periodically moves parallel to the striking direction 5 between a drive-side reversing point and a tool-side reversing point. The tool-side reversing point is predetermined by the anvil 14 against which the striker 13 strikes in the tool-side reversing point. The anvil 14 transmits the impact to the tool 3 arranged in the tool holder 2.

A striking rate is largely fixed for the portable power tool 1 with the pneumatic striking mechanism 4. The striking rate corresponds to the period of revolution of the exciter piston 12. The period of revolution is matched to the flight time of the striker 13 in order to ensure efficient energy transfer. Here, the striking mechanism 4 shows a behavior of the kind typically known from resonantly excited systems. Optimum energy transfer is ensured at the nominal striking rate of the portable power tool 1. Deviations of more than 10% typically already lead to an unacceptable reduction in efficiency. Typical striking rates are in a range of from 10 strikes per second to 100 strikes per second. Chipping hammers with a high impact energy above 20 J (joules) typically have a low striking rate in a range of between 10 and 40 strikes per second. Chipping hammers and combination hammers with medium and low impact energies in a range of between 0.5 J and 20 J typically have striking rates in a range of between 40 and 100 strikes per second.

The pneumatic striking mechanism 4 intentionally has highly discontinuous behavior during power output. The striker 13 outputs the kinetic energy received during one revolution in the form of a blow within a very short time. This leads to discontinuous power consumption of the pneumatic striking mechanism 4 from the electric motor 8. The striker 13 is accelerated in the striking direction 5 in less than one eighth of the revolution by the exciter piston 12. In other respects, the striker 13 moves virtually in a force-free manner. This leads to considerable load reversals for the driving electric motor 8. Current portable power tools therefore use electric motors that have a rotor 20 with a high moment of inertia. The moment of inertia acts as it were as a buffer during the acceleration phase of the striker 13.

The embodiment of the portable power tool 1 follows a different approach. The electric motor 8 is designed to be able to respond directly to the dynamic load reversals of the striking mechanism 4. For this purpose, the electric motor 8 has a high speed in comparison with the striking rate of the pneumatic striking mechanism 4. The speed is at least 20 times, preferably at least 30 times, the striking rate. In other words, during operation the rotor of the electric motor 8 rotates at least 20 times per strike and thus per revolution of the striker 13. During the short acceleration phase of the striker 13, the electric motor 8 rotates at least two to three times. The energy output per revolution of the rotor 20 is preferably less than 1 joule.

The gear train 15 has a reduction ratio of at least 20 to 1, preferably at least 20 to 1, preferably at least 30 to 1. An upper limit for the reduction ratio is thought to be 80 to 1. The high reduction ratio requires several stages selected in series. First of all, each transmission stage increases the moment of inertia, reducing dynamism. Moreover, losses are incurred due to friction, among other causes. At a low speed of 2000 rpm, typical losses are between 90% and 95%. The losses rise with increasing speed. And the multiple stages require volume, which runs counter to the trend for compact construction of portable power tools 1. A planetary transmission stage 150 can be coupled as first stage directly to the electric motor.

The electric motor 8 has a high nominal speed. The nominal speed is greater than 80,000 revolutions per minute. At the nominal speed of the electric motor 8, the striking mechanism 4 strikes at the nominal striking rate, i.e. the striking mechanism 4 operates at the optimum efficiency. The speed of the electric motor 8 is preferably less than 200,000 revolutions per minute. Electric motors with higher speeds would probably require a delicate construction of the rotor 20 which would not permanently withstand the load reversals and associated torque changes.

At the nominal speed, the electric motor 8 has a power output of at least 250 W (watts). For relatively large combination hammers or chipping hammers, an electric motor 8 with a power output of at least 500 W up to 3000 W is required.

The electric motor 8 is preferably a brushless electric motor 8. The brushless electric motor 8 has a stator 21 and a rotor 20. The stator 21 generates a rotating magnetic field which determines the speed of the rotor 20. The rotor 20 can contain permanent magnets, which interact with the rotating magnetic field, as in a so-called BLCD motor.

The electric motor 8 preferably has a rotor 20 with a low moment of inertia to ensure that the electric motor 8 can respond dynamically to the load reversals. A moment of inertia of the rotor 20 is preferably less than 250 g/cm$^2$ (grams per square centimeter). The electric motor 8 allows a high acceleration, a mass of the electric motor 8 to its nominal power preferably being less than 0.2 g/W (grams per watt). A lower limit is around 0.03 g/W. For this purpose, the rotor 20 preferably has an elongate construction. A length of the rotor 20 is significantly greater than the diameter of the rotor 20, preferably at least 3 times as long.

The invention claimed is:

1. A portable power chiseling tool, comprising a tool holder for holding a tool on a working axis, an electric motor, the electric motor having a mass and a rated power, a striking mechanism, which has an exciter piston coupled to the electric motor, a striker guided on the working axis, a pneumatic chamber, which is closed by the exciter piston and the striker and is provided for coupling a movement of the striker to the exciter piston, wherein a speed of the electric motor corresponds to at least 20 times a striking rate of the striking mechanism, a speed of the electric motor is greater than 80,000 revolutions per minute, and a ratio of the mass of the electric motor to the rated power of the electric motor is less than 0.2 g/W.

2. The portable power chiseling tool as claimed in claim 1, wherein the striking mechanism is supplied with no more than 1 joule per revolution of the electric motor.

3. The portable power chiseling tool as claimed in claim 1, wherein the electric motor has a rotor and a moment of inertia of the rotor is less than 250 g/cm$^2$.

4. The portable power chiseling tool as claimed in claim 1, comprising a transmission, which is arranged in a power path between the electric motor and the striking mechanism, wherein the transmission contains at least one planetary transmission stage.

5. The portable power chiseling tool as claimed in claim 4, wherein the planetary transmission stage is arranged directly on a rotor of the electric motor.

6. The portable power chiseling tool as claimed in claim 2, wherein the electric motor has a rotor and a moment of inertia of the rotor is less than 250 g/cm$^2$.

7. The portable power chiseling tool as claimed in claim 2, comprising a transmission, which is arranged in a power path between the electric motor and the striking mechanism, wherein the transmission contains at least one planetary transmission stage.

8. The portable power chiseling tool as claimed in claim 3, comprising a transmission, which is arranged in a power path between the electric motor and the striking mechanism, wherein the transmission contains at least one planetary transmission stage.

9. The portable power chiseling tool as claimed in claim 6, comprising a transmission, which is arranged in a power path between the electric motor and the striking mechanism, wherein the transmission contains at least one planetary transmission stage.

10. The portable power chiseling tool as claimed in claim 7, wherein the planetary transmission stage is arranged directly on a rotor of the electric motor.

11. The portable power chiseling tool as claimed in claim 8, wherein the planetary transmission stage is arranged directly on a rotor of the electric motor.

12. The portable power chiseling tool as claimed in claim 9, wherein the planetary transmission stage is arranged directly on a rotor of the electric motor.

* * * * *